US006119466A

United States Patent [19]

Vaillancourt

[11] Patent Number: 6,119,466

[45] Date of Patent: Sep. 19, 2000

[54] ICE SURFACE

[75] Inventor: Wilf Vaillancourt, 275 Albert Street East Apartment 1101, Sault Ste. Mar, Ontario, Canada, P6A 6N7

[73] Assignee: Wilf Vaillancourt, Sault Ste. Marie, Canada

[21] Appl. No.: 09/167,497

[22] Filed: Oct. 7, 1998

[30] Foreign Application Priority Data

Oct. 7, 1997 [CA] Canada ..... 2213114

[51] Int. Cl.[7] ..... F25C 3/02

[52] U.S. Cl. ..... 62/66; 62/235; 252/70

[58] Field of Search ..... 62/66, 235, 340; 252/70; 103/13

[56] References Cited

U.S. PATENT DOCUMENTS 4,953,360 9/1990 Rzechula ..... 62/66

5,409,622 4/1995 Chapman et al. ..... 252/25

*Primary Examiner*—William E. Tapolcal

*Attorney, Agent, or Firm*—Bereskin & Parr

[57] ABSTRACT

This invention relates to a method of resurfacing an ice surface to reduce friction between the ice and an object gliding on the ice surface. The steps comprise mixing an effective amount of lubricant with water, coating the ice surface with the mixture, and allowing the mixture to freeze to form a new ice surface. In particular, the lubricant is derived from siloxane. In the preferred embodiment, the lubricant is a composition derived from polydimethysiloxane and copolyolamine. In the preferred embodiment, the ratio of water mixed with the lubricant is 300:1. This invention also provides for the use of the composition as an agent to reduce friction between an ice surface and an object gliding on the ice surface. In particular, an effective amount of the composition is mixed with water prior to applying the mixture to a surface upon which the ice surface is to form.

3 Claims, No Drawings

ICE SURFACE

FIELD OF THE INVENTION

This invention relates to a method of resurfacing an ice surface to reduce friction between the ice and an object gliding on the ice surface. This invention also relates to the use of a composition derived from siloxane as the agent to reduce friction in an ice surface.

BACKGROUND OF THE INVENTION

One problem faced by many arenas is the maintenance of proper ice conditions. The problem can be appreciated when thousands of people gather to watch, for example, a hockey game. The heat generated from such a gathering of people aids in the formation of wet slow ice. This produces a very slow skating surface, which is aggravating to the hockey players. It is desirable to have a harder, faster ice surface.

One patent that discloses an additive for treating water used to form ice is U.S. Pat. No. 4,953,360. This patent is primarily concerned with an additive that allows cool water to be used in resurfacing ice rinks. The additive comprises a surfactant, a silicone, and a primary alcohol. By using cool water—as opposed to hot water—during resurfacing, energy to heat and then cool the water is saved.

The present invention relates to a method of resurfacing an ice surface to reduce friction between the ice and an object gliding on the ice surface. The use of a composition derived from siloxane as the agent to reduce friction with the ice surface is disclosed. This results in a harder, faster ice surface.

SUMMARY OF THE PRESENT INVENTION

Accordingly, this invention provides a method of resurfacing an ice surface to reduce friction between the ice and an object gliding on the ice surface, comprising the steps of:

mixing an effective amount of lubricant with water;

coating the ice surface with the mixture; and allowing the mixture to freeze to form a new ice surface.

In particular, the lubricant is derived from siloxane. In the preferred embodiment, the lubricant is a composition derived from polydimethysiloxane and copolyolamine, and is sold commercially under the name TRASIL 1 AF by Thomson Research Associates, of Granby, Quebec, Canada.

In the preferred embodiment the ratio of water mixed with the lubricant, namely, TRASIL 1 AF is 300:1.

This invention also provides for the use of the composition as an agent to reduce friction between an ice surface and an object gliding on the ice surface. In particular, an effective amount of the composition is mixed with water prior to applying the mixture to a surface upon which the ice surface is to form.

DESCRIPTION OF PREFERRED EMBODIMENT

In a typical arena or ice rink when it is time to resurface the ice, a machine, such as a ZAMBONI machine, planes the surface layer, smoothing the ice, and lays down a covering or coating of water. This layer of water freezes, forming a new surface.

This invention provides a method of resurfacing an ice surface using, for example, a ZAMBONI machine, but instead of laying down a covering or coating of water lays down a mixture that reduces friction between the ice and an object gliding on the ice surface, such as, for example, a skate blade.

To reduce friction a lubricant is mixed with the water. In particular, the lubricant is derived from siloxane. In the preferred embodiment, the lubricant is a composition derived from polydimethysiloxane and copolyolamine, and is sold commercially under the name TRASIL 1 AF by Thomson Research Associates, of Granby, Quebec, Canada. Using this composition the ratio of water mixed with the lubricant is 300:1. Of course it will be realized to those skilled in the art that this ratio can be adjusted as needed as all arenas or ice rinks vary with regards to building, ice and refrigeration temperature.

Once an effective amount of lubricant is mixed with water (which, in the preferred embodiment is mixed in the ZAMBONI machine), the ZAMBONI machine covers or coats the ice surface with the mixture, which, when freezes forms a new ice surface. It will be appreciated to those skilled in the art that other means of applying the lubricant to the ice surface can be found, for example, by use of an atomized spray.

The use of the disclosed composition as a lubricating agent to reduce friction between an ice surface and an object gliding on the ice surface provides for faster, yet quieter skating. This was tested by applying a pair of skates to a two-hundred pound weight platform. A 60% decrease in friction on an ice surface using a mixture of TRASIL 1 AF and water was found.

Another advantage of applying the preferred composition is that ice buildup is reduced. Further, an ice surface formed from the above mixture is harder allowing a thinner ice base to be applied to an arena or ice rink, which in turn, reduces refrigeration costs. Thinner ice also allows for a smoother surface. Typical arenas or ice rinks have an ice thickness of about 11/2". Using the mixture of TRASIL 1 AF and water as disclosed, it was found that ice thickness is reduced to 1".

It can be appreciated that variations to this invention would be readily apparent to those skilled in the art, and this invention is intended to include those alternatives.

What is claimed is:

1. A method of resurfacing an ice surface to reduce friction between the ice and an object gliding on the ice surface, the method comprising:

mixing an effective amount of lubricant derived from siloxane with water;

coating the ice surface with the mixture; and allowing the mixture to freeze to form a new ice surface.

2. The method according to claim 1 wherein the lubricant is a composition derived from polydimethysiloxane and copolyolamine.

3. The method according to claim 2 wherein the ratio of water mixed with lubricant is 300:1.

* * * * *